United States Patent [19]

Carmichael et al.

[11] Patent Number: 4,725,518

[45] Date of Patent: Feb. 16, 1988

[54] ELECTROPHOTOGRAPHIC IMAGING SYSTEM COMPRISING CHARGE TRANSPORTING AROMATIC AMINE COMPOUND AND PROTONIC ACID OR LEWIS ACID

[75] Inventors: Kathleen M. Carmichael, Williamson; Frederick D. Gonyea, Fairport; Edward F. Grabowski, Webster; Anthony M. Horgan, Pittsford; Jay W. Johns, Webster; Robert N. Jones, Fairport; Anita P. Lynch; Susan Robinette, both of Webster; Donald P. Sullivan; Emery G. Tokoli, both of Rochester, all of N.Y.

[73] Assignee: Xerox Corporation, Stamford, Conn.

[21] Appl. No.: 610,548

[22] Filed: May 15, 1984

[51] Int. Cl.[4] ..... G03G 15/02; G03G 15/05; G03G 5/00

[52] U.S. Cl. ..... 430/58; 430/59; 430/96; 430/132

[58] Field of Search ..... 430/58, 59, 96, 132

[56] References Cited

U.S. PATENT DOCUMENTS

| | | | |
|---|---|---|---|
| 3,997,342 | 12/1976 | Bailey | 96/58 |
| 4,047,949 | 9/1977 | Horgan | 430/59 |
| 4,072,520 | 2/1978 | Rochlitz et al. | 96/15 R |
| 4,081,274 | 3/1978 | Horgan | 96/1 PC |
| 4,175,960 | 11/1979 | Berwick et al. | 430/58 |
| 4,265,990 | 5/1981 | Stolka et al. | 430/59 |
| 4,291,110 | 9/1981 | Lee | 430/58 X |
| 4,293,630 | 10/1981 | Oka | 430/59 |
| 4,338,222 | 7/1982 | Limburg et al. | 252/500 |
| 4,464,450 | 8/1984 | Teuscher | 430/59 |
| 4,467,023 | 8/1984 | Chu et al. | 430/62 X |

FOREIGN PATENT DOCUMENTS

| | | |
|---|---|---|
| 54-065671 | 5/1979 | Japan . |
| 55-57748 | 8/1980 | Japan . |

OTHER PUBLICATIONS

Kirk-Othmer, Encyclopedia of Chemical Technology, Second Edition, vol. 7, pp. 391-396, 1965.

Kenneth B. Wiberg, Laboratory Technique in Organic Chemistry, McGraw-Hill Book Co. Inc., 1960, pp. 20-22.

U.S. Patent Appln. Serial No. 142,198, filed 4/21/80, (corresponds to Japanese Patent '748, of record).

*Primary Examiner*—Mukund J. Shah

[57] ABSTRACT

A process for preparing an electrophotographic imaging member comprising providing a photogenerating layer on a supporting substrate and applying a charge transport layer forming mixture to the photogenerating layer, the charge transport layer forming mixture comprising a charge transporting aromatic amine compound of one or more compounds having the general formula:

wherein $R^1$ and $R^2$ are an aromatic group selected from the group consisting of a substituted or unsubstituted phenyl group, naphthyl group, and polyphenyl group and $R^3$ is selected from the group consisting of a substituted or unsubstituted aryl, and alkyl group having from 1 to 18 carbon atoms and cycloaliphatic group having from 3 to 12 carbon atoms, a polymeric film forming resin in which the aromatic amine is soluble, solvent for the polymeric film forming resin, and from about 1 part per million to about 10,000 parts per million, based on the weight of the aromatic amine, of a protonic acid or Lewis acid having a boiling point greater than about 40° C. and soluble in the solvent.

10 Claims, 3 Drawing Figures

VOLTS
700
600
500
400
300
200
100
0
PPM
0
20
40
60
80
100
200
300
400
500
600
VDDP
VBG
TREATED CF3COOH
TREATED CCl3COOH
TREATED CCl3COOH
TREATED CF3COOH

ELECTROPHOTOGRAPHIC IMAGING SYSTEM COMPRISING CHARGE TRANSPORTING AROMATIC AMINE COMPOUND AND PROTONIC ACID OR LEWIS ACID

BACKGROUND OF THE INVENTION

This invention relates in general to electrostatography and, more specifically, to a process for preparing a photoconductive device.

In the art of xerography, a xerographic plate containing a photoconductive insulating layer is imaged by first uniformly electrostatically charging its surface. The plate is then exposed to a pattern of activating electromagnetic radiation such as light, which selectively dissipates the charge in the illuminated areas of the photoconductive insulator while leaving behind an electrostatic latent image in the non-illuminated areas. This electrostatic latent image may then be developed to form a visible image by depositing finely divided electroscopic marking particles on the surface of the photoconductive insulating layer.

A photoconductive layer for use in xerography may be a homogeneous layer of a single material such as vitreous selenium or it may be a composite layer containing a photoconductor and another material. One type of composite photoconductive layer used in xerography is illustrated in U.S. Pat. No. 4,265,990 which describes a photosensitive member having at least two electrically operative layers. One layer comprises a photoconductive layer which is capable of photogenerating holes and injecting the photogenerated holes into a contiguous charge transport layer. Generally, where the two electrically operative layers are supported on a conductive layer with the photoconductive layer capable of photogenerating holes and injecting photogenerated holes sandwiched between the contiguous charge transport layer and the supporting conductive layer, the outer surface of the charge transport layer is normally charged with a uniform charge of a negative polarity and the supporting electrode is utilized as an anode. Obviously, the supporting electrode may also function as an anode when the charge transport layer is sandwiched between the electrode and a photoconductive layer which is capable of photogenerating electrons and injecting the photogenerated electrons into the charge transport layer. The charge transport layer in this embodiment, of course, must be capable of supporting the injection of photogenerated electrons from the photoconductive layer and transporting the electrons through the charge transport layer.

Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain aromatic amine compound. Various generating layers comprising photoconductive layers exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generation layer may comprise a homogeneous photoconductive material or particulate photoconductive material dispersed in a binder. Other examples of homogeneous and binder charge generation layer are disclosed in U.S. Pat. No. 4,265,990. Additional examples of binder materials such as poly(hydroxyether) resins are taught in U.S. Pat. No. 4,439,507. The disclosures of the aforesaid U.S. Pat. No. 4,265,990 and U.S. Pat. No. 4,439,507 are incorporated herein in their entirety. Photosensitive members having at least two electrically operative layers as disclosed above in, for example, U.S. Pat. No. 4,265,990 provide excellent images when charged with a uniform negative electrostatic charge, exposed to a light image and thereafter developed with finely developed electroscopic marking particles. However, when the charge transport layer comprises a film forming resin and one or more of certain diamine compound, difficulities have been encountered with these photosensitive members when they are used in high volume, high speed copiers, duplicators and printers. For example, it has been found that when certain charge transport layers comprise a film forming resin and an aromatic amine compound, the dark decay characteristics are unpredictable from one production batch to another. Dark decay is defined as the loss of charge on a photoreceptor in the dark after uniform charging. This unpredictability characteristic is highly undesirable, particularly for high volume, high speed copiers, duplicators and printers which require precise, stable, and predictable photoreceptor operating ranges. Erratic variations in dark decay rate can be unacceptable or at, the very least, require expensive and sophisticated control systems or trained repair persons to alter machine operating parameters such as charging potentials, toner concentration and the like to compensate for different photoreceptor dark decay rates. Failure to adequately compensate for dark decay rate differences can result in copies of poor copy quality. Moreover, such variations in dark decay rate prevent achievement of optimized dark decay properties.

Similarly, photoreceptors utilizing charge transport layers comprising a film forming resin and one or more of certain aromatic amine compounds also exhibit eratic variations in background potential from one production batch to another. Background potential is defined as the potential in the background or light struck areas of a photosensitive member after exposure to a pattern of activating electromagnetic radiation such as light. Unpredictable variations in background potential can adversely affect copy quality, especially in complex, high volume, high speed copiers, duplicators and printers which by their very nature require photoreceptor properties to meet precise narrow operating windows. Thus, like photoreceptors that exhibit batch to batch dark decay variations, photosensitive members that have poor background potential characteristics are also unacceptable or require expensive and sophisticated control systems or trained repair persons to alter machine operating parameters. Inadequate compensation of background potential variations can cause copies to appear too light or too dark. In addition, such variations in background potential properties preclude optimization of background potential properties.

Control of both $V_{DDP}$ and $V_{BG}$ of photosensitive members is important not only initially but through the entire cycling life of the photosensitive members.

Thus, the characteristics of photosensitive members comprising a conductive layer and at least two electrically operative layers, one of which is a charge transport layer comprising a film forming resin and one or more aromatic amine compounds, exhibit deficiencies which are undesirable in high quality, high volume, high speed copiers, duplicators, and printers.

SUMMARY OF THE INVENTION

It is an object of the invention to provide a process for preparing an electrophotographic imaging member comprising providing a photogenerating layer on a supporting substrate and applying a charge transport layer forming mixture to the photogenerating layer, the charge transport layer forming mixture comprising an aromatic amine compound of one or more compounds having the general formula:

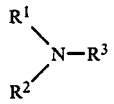

wherein $R^1$ and $R^2$ are an aromatic group selected from the group consisting of a substituted or unsubstituted phenyl group, naphthyl group, and polyphenyl group and $R^3$ is selected from the group consisting of a substituted or unsubstituted aryl group, alkyl group having from 1 to 18 carbon atoms, and cycloaliphatic compounds having from 3 to 12 carbon atoms, a polymeric film forming resin in which the aromatic amine is soluble, a solvent such as methylene chloride for the polymeric film forming resin, and from about 1 part per million to about 10,000 parts per million, based on the weight of the aromatic amine compound, of a protonic acid or Lewis acid having a boiling point preferably greater than about 40° C. and soluble in the solvent.

BRIEF DESCRIPTION OF THE DRAWINGS

A more complete understanding of the process and device of the present invention can be obtained by reference to the accompanying drawings wherein.

Figure 1:
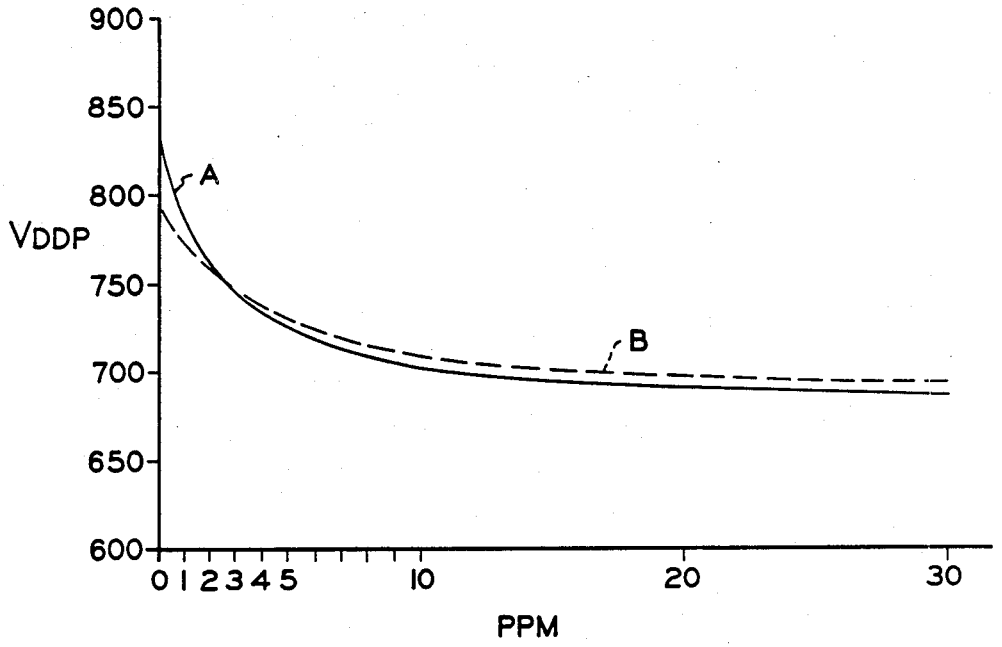
FIG. 1 graphically illustrates dark decay ($V_{DDP}$) characteristics with treated and untreated photosensitive members having two electrically operative layers on a conductive layer.

Generally, an electrophotoconductive member prepared with the process of this invention comprises two electrically operative layers on a supporting substrate. The substrate may be opaque or substantially transparent and may comprise numerous suitable materials having the required mechanical properties.

A conductive layer or ground plane which may comprise the entire supporting substrate or be present as a coating on an underlying member may comprise any suitable material including, for example, aluminum, titanium, nickel, chromium, brass, gold, stainless steel, carbon black, graphite and the like. The conductive layer may vary in thickness over substantially wide ranges depending on the desired use of the electrophotoconductive member. Accordingly, the conductive layer can generally range in thickness of from about 50 Angstrom units to many centimeters. When a flexible photoresponsive imaging device is desired, the thickness may be between about 100 Angstrom units to about 750 Angstrom units. The underlying member may be of any conventional material including metal, plastics and the like. Typical underlying members include insulating non-conducting materials comprising various resins known for this purpose including polyesters, polycarbonates, polyamides, polurethanes, and the like. The coated or uncoated supporting substrate may be flexible or rigid and may have any number of many different configurations such as, for example, a plate, a cylindrical drum, a scroll, an endless flexible belt, and the like. Preferably, the insulating substrate is in the form of an endless flexible belt and comprises a commercially available polyethylene terephthalate polyester known as Mylar available from E. I. du Pont de Nemours & Co.

If desired, any suitable blocking layer may be interposed between the conductive layer and the charge generating layer. A preferred blocking layer comprises a reaction product between a hydrolyzed silane and a metal oxide layer of a conductive anode, the hydrolyzed silane having the general formula:

I.

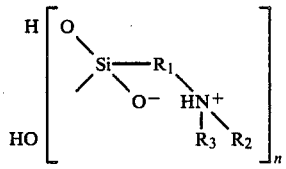

II.

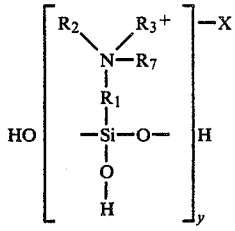

or a mixtures thereof, wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is an anion of an acid or acidic salt (not intending to exclude the tree base of these salts), n is 1, 2, 3 or 4, and y is 1, 2, 3 or 4. The imaging member is prepared by depositing on the metal oxide layer of a metallic conductive anode layer a coating of an aqueous solution of the hydrolyzed silane at a pH between about 4 and about 10, drying the reaction product layer to form a siloxane film and applying the generating layer and charge transport layer to the siloxane film.

The hydrolyzed silane may be prepared by hydrolyzing a silane having the following structural formula:

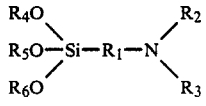

wherein $R_1$ is an alkylidene group containing 1 to 20 carbon atoms, $R_2$ and $R_3$ are independently selected from H, a lower alkyl group containing 1 to 3 carbon atoms, a phenyl group and a poly(ethylene)-amino or ethylene diamine group, and $R_4$, $R_5$ and $R_6$ are independently selected from a lower alkyl group containing 1 to 4 carbon atoms. Typical hydrolyzable silanes include 3-aminopropyl triethoxy silane, (N,N'-dimethyl 3-amino)propyl triethoxysilane, N,N-dimethylamino phenyl triethoxy silane, N-phenyl aminopropyl trimethoxy silane, trimethoxy silylpropyldiethylene triamine and mixtures thereof.

If $R_1$ is extended into a long chain, the compound becomes less stable. Silanes in which $R_1$ contains about 3 to about 6 carbon atoms are preferred because the molecule is more stable, is more flexible and is under less strain. Optimum results are achieved when $R_1$ contains 3 carbon atoms. Satisfactory results are achieved when $R_2$ and $R_3$ are alkyl groups. Optimum smooth and uniform films are formed with hydrolyzed silanes in which $R_2$ and $R_3$ are hydrogen. Satisfactory hydrolysis of the silane may be effected when $R_4$, $R_5$ and $R_6$ are alkyl groups containing 1 to 4 carbon atoms. When the alkyl groups exceed 4 carbon atoms, hydrolysis becomes impractically slow. However, hydrolysis of silanes with alkyl groups containing 2 carbon atoms are preferred for best results.

During hydrolysis of the amino silanes described above, the alkoxy groups are replaced with hydroxyl groups. As hydrolysis continues, the hydrolyzed silane takes on the following intermediate general structure:

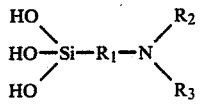

After drying, the siloxane reaction product film formed from the hydrolyzed silane contains larger molecules in which n is equal to or greater than 6. The reaction product of the hydrolyzed silane may be linear, partially crosslinked, a dimer, a trimer, and the like.

The hydrolyzed silane solution may be prepared by adding sufficient water to hydrolyze the alkoxy groups attached to the silicon atom to form a solution. Insufficient water will normally cause the hydrolyzed silane to form an undesirable gel. Generally, dilute solutions are preferred for achieving thin coatings. Satisfactory reaction product films may be achieved with solutions containing from about 0.1 percent by weight to about 1.5 percent by weight of the silane based on the total weight of the solution. A solution containing from about 0.05 percent by weight to about 0.2 percent by weight silane based on the total weight of solution are preferred for stable solutions which form uniform reaction product layers. It is critical that the pH of the solution of hydrolyzed silane be carefully controlled to obtain optimum electrical stability. A solution pH between about 4 and about 10 is preferred. Thick reaction product layers are difficult to form at solution pH greater than about 10. Moreover, the reaction product film flexibility is also adversely affected when utilizing solutions having a pH greater than about 10. Further, hydrolyzed silane solutions having a pH greater than about 10 or less than about 4 tend to severly corrode metallic conductive anode layers such as those containing aluminum during storage of finished photoreceptor products. Optimum reaction product layers are achieved with hydrolyzed silane solutions having a pH between about 7 and about 8, because inhibition of cycling-up and cycling-down characteristics of the resulting treated photoreceptor are maximized. Some tolerable cycling-down has been observed with hydrolyzed amino silane solutions having a pH less than about 4.

Control of the pH of the hydrolyzed silane solution may be effected with any suitable organic or inorganic acid or acidic salt. Typical organic and inorganic acids and acidic salts include acetic acid, citric acid, formic acid, hydrogen iodide, phosphoric acid, ammonium chloride, hydrofluorsilicic acid, Bromocresol Green, Bromophenol Blue, p-toluene sulfonic acid and the like.

If desired, the aqueous solution of hydrolyzed silane may also contain additives such as polar solvents other than water to promote improved wetting of the metal oxide layer of metallic conductive anode layers. Improved wetting ensures greater uniformity of reaction between the hydrolyzed silane and the metal oxide layer. Any suitable polar solvent additive may be employed. Typical polar solvents include methanol, ethanol, isopropanol, tetrahydrofuran, methylcellosolve, ethylcellosolve, ethoxyethanol, ethylacetate, ethylformate and mixtures thereof. Optimum wetting is achieved with ethanol as the polar solvent additive. Generally, the amount of polar solvent added to the hydrolyzed silane solution is less than about 95 percent based on the total weight of the solution.

Any suitable technique may be utilized to apply the hydrolyzed silane solution to the metal oxide layer of a metallic conductive anode layer. Typical application techniques include spraying, dip coating, roll coating, wire wound rod coating, and the like. Although it is preferred that the aqueous solution of hydrolyzed silane be prepared prior to application to the metal oxide layer, one may apply the silane directly to the metal oxide layer and hydrolyze the silane in situ by treating the deposited silane coating with water vapor to form a hydrolyzed silane solution on the surface of the metal oxide layer in the pH range described above. The water vapor may be in the form of steam or humid air. Generally, satisfactory results may be achieved when the reaction product of the hydrolyzed silane and metal oxide layer forms a layer having a thickness between about 20 Angstroms and about 2,000 Angstroms. As the reaction product layer becomes thinner, cycling instability begins to increase. As the thickness of the reaction product layer increases, the reaction product layer becomes more non-conducting and residual charge tends to increase because of trapping of electrons and thicker reaction product films tend to become brittle prior to the point where increases in residual charges become unacceptable. A brittle coating is, of course, not suitable for flexible photoreceptors, particularly in high speed, high volume copiers, duplicators and printers.

Drying or curing of the hydrolyzed silane upon the metal oxide layer should be conducted at a temperature greater than about room temperature to provide a reaction product layer having more uniform electrical properties, more complete conversion of the hydrolyzed silane to siloxanes and less unreacted silanol. Generally, a reaction temperature between about 100° C. and about 150° C. is preferred for maximum stabilization of electrochemical properties. The temperature selected depends to some extent on the specific metal oxide layer utilized and is limited by the temperature sensitivity of the substrate. Reaction product layers having optimum electrochemical stability are obtained when reactions are conducted at temperatures of about 135° C. The reaction temperature may be maintained by any suitable technique such as ovens, forced air ovens, radiant heat lamps, and the like.

The reaction time depends upon the reaction temperatures used. Thus less reaction time is required when higher reaction temperatures are employed. Generally, increasing the reaction time increases the degree of cross-linking of the hydrolyzed silane. Satisfactory results have been achieved with reaction times between about 0.5 minute to about 45 minutes at elevated temperatures. For practical purposes, sufficient crosslinking is achieved by the time the reaction product layer is dry provided that the pH of the aqueous solution is maintained between about 4 and about 10.

The reaction may be conducted under any suitable pressure including atmospheric pressure or in a vacuum. Less heat energy is required when the reaction is conducted at sub-atmospheric pressures.

One may readily determine whether sufficient condensation and crosslinking has occured to form a siloxane reaction product film having stable electric chemical properties in a machine environment by merely washing the siloxane reaction product film with water, toluene, tetrahydrofuran, methylene chloride or cyclohexanone and examining the washed siloxane reaction product film to compare infrared absorption of Si—O— wavelength bands between about 1,000 to about 1,200 $cm^{-1}$. If the Si—O— wavelength bands are visible, the degree of reaction is sufficient, i.e. sufficient condensation and cross-linking has occurred, if peaks in the bands do not diminish from one infrared absorption test to the next. It is believed that the partially polymerized reaction product contains siloxane and silanol moieties in the same molecule. The expression "partially polymerized" is used because total polymerization is normally not achievable even under the most severe drying or curing conditions. The hydrolyzed silane appears to react with metal hydroxide molecules in the pores of the metal oxide layer. This siloxane coating is described in U.S. Pat. No. 4,464,450, Ser. No. 420,962 entitled Multi-layer Photoreceptor Containing Siloxane on a Metal Oxide Layer, filed Sept. 21, 1982 in the name of Leon A. Teuscher, the disclosure of this application being incorporated herein in its entirety.

In some cases, intermediate layers between the blocking layer and the adjacent charge generating or photogenerating material may be desired to improve adhesion or to act as an electrical barrier layer. If such layers are utilized, they have a dry thickness between about 0.01 micron to about 5 microns. Typical adhesive layers include film-forming polymers such as polyester, polyvinylbutyral, polyvinylpyrolidone, polyurethane, polymethyl methacrylate and the like.

Any suitable charge generating or photogenerating material may be employed in one of the two electrically operative layers in the multilayer photoconductor prepared by the process of this invention. Typical charge generating materials include metal free phthalocyanine described in U.S. Pat. No. 3,357,989, metal phthalocyanines such as copper phthalocyanine, quinacridones available from DuPont under the tradename Monastral Red, Monastral Violet and Monastral Red Y, substituted 2,4-diamino-triazines disclosed in U.S. Pat. No. 3,442,781, and polynuclear aromatic quinones available from Allied Chemical Corporation under the tradename Indofast Double Scarlet, Indofast Violet Lake B, Indofast Brilliant Scarlet and Indofast Orange. Other examples of charge generator layers are disclosed in U.S. Pat. No. 4,265,990, U.S. Pat. No. 4,233,384, U.S. Pat. No. 4,306,008, U.S. Pat. No. 4,299,897, U.S. Pat. No. 4,232,102, U.S. Pat. No. 4,233,383, U.S. Pat. No. 4,415,639 and U.S. Pat. No. 4,439,507. The disclosures of these patents are incorporated herein in their entirety.

Any suitable inactive resin binder material may be employed in the charge generator layer. Typical organic resinous binders include polycarbonates, acrylate polymers, vinyl polymers, cellulose polymers, polyesters, polysiloxanes, polyamides, polyurethanes, epoxies, and the like. Many organic resinous binders are disclosed, for example, in U.S. Pat. No. 3,121,006 and U.S. Pat. No. 4,439,507, the entire disclosures of which are incorporated herein by reference. Organic resinous polymers may be block, random or alternating copolymers. Excellent results have been achieved with a resinous binder material comprised of a poly(hydroxyether) material selected from the group consisting of those of the following formulas:

I.

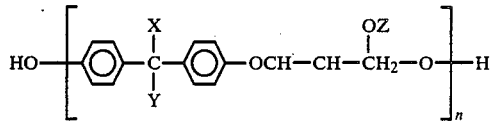

and

II.

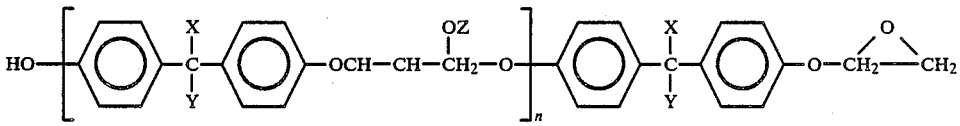

wherein X and Y are independently selected from the group consisting of aliphatic groups and aromatic groups, Z is hydrogen, an aliphatic group, or an aromatic group, and n is a number of from about 50 to about 200.

These poly(hydroxyethers), some of which are commercially available from Union Carbide Corporation, are generally described in the literature as phenoxy resins, or epoxy resins.

Examples of aliphatic groups for the poly(hydroxyethers), include those containing from about 1 carbon atom to about 30 carbon atoms, such as methyl, ethyl, propyl, butyl, pentyl, hexyl, heptyl, decyl, pentadecyl, eicodecyl, and the like. Preferred aliphatic groups include alkyl groups containing from about 1 carbon atom to about 6 carbon atoms, such as methyl, ethyl, propyl, and butyl. Illustrative examples of aromatic groups include those containing from about 6 carbon atoms to about 25 carbon atoms, such as phenyl, napthyl, anthryl and the like, with phenyl being preferred. Encompassed within the present invention are aliphatic and aromatic groups which can be substituted with various known substituents, including for example, alkyl, halogen, nitro, sulfo, and the like.

Examples of the Z substituent include hydrogen, as well as aliphatic, aromatic, substituted aliphatic, and substituted aromatic groups as defined herein. Furthermore, Z can be selected from carboxyl, carbonyl, carbonate, and other similar groups, resulting in for example, the corresponding esters, and carbonates of the poly(hydroxyethers).

Preferred poly(hydroxyethers) include those wherein X and Y are alkyl groups, such as methyl, Z is hydrogen or a carbonate group, and n is a number ranging from about 75 to about 100. Specific preferred poly(hydroxyethers) include Bakelite, phenoxy resin PKHH, commercially available from Union Carbide Corporation and resulting from the reaction of 2,2-bis(4-hydroxyphenylpropane), or bisphenol A, with epichlorohydrin, an epoxy resin, Araldite ®6097, commercially available from CIBA, the phenylcarbonate of the poly(hydroxyether), wherein Z is a carbonate grouping, which material is commercially available from Allied Chemical Corporation, as well as poly(hydroxyethers) derived from dichloro bis phenol A, tetrachloro bis phenol A, tetrabromo bis phenol A, bis phenol F, bis phenol ACP, bis phenol L, bis phenol V, bis phenol S, and the like and epichlorohydrins.

The photogenerating layer containing photoconductive compositions and/or pigments, and the resinous binder material generally ranges in thickness of from about 0.1 micrometer to about 5.0 micrometers, and preferably has a thickness of from about 0.3 micrometer to about 3 micrometers. Thicknesses from about 0.1 micrometer to about 10 micrometers outside these ranges can be selected providing the objectives of the present invention are achieved.

The photogenerating composition or pigment is present in the resinous binder composition in various amounts, generally, however, from about 5 percent by volume to about 60 percent by volume of the photogenerating pigment is dispersed in about 40 percent by volume to about 95 percent by volume of polyvinyl carbazole or the poly(hydroxyether) binder, and preferably from about 7 percent to about 30 percent by volume of the photogenerating pigment is dispersed in from about 70 percent by volume to about 93 percent by volume of the polyvinyl carbazole or poly(hydroxyether) binder composition. The specific proportions selected depends to some extent on the thickness of the generator layer.

Other typical photoconductive layers include amorphous or alloys of selenium such as selenium-arsenic, selenium-tellurium-arsenic, and selenium-tellurium.

The transport layer employed in the in one of the two electrically operative layers in the multilayer photoconductor prepared by the process of this invention comprises about 25 to about 75 percent by weight of at least one charge transporting aromatic amine compound, about 75 to about 25 percent by weight of an polymeric film forming resin in which the aromatic amine is soluble, and about 1 to about 10,000 parts per million based on the weight of the aromatic amine of protonic acid or Lewis acid soluble in a suitable solvent such as methylene chloride.

The aromatic amine compound may be of one or more compounds having the general formula:

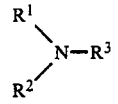

wherein $R^1$ and $R^2$ are an aromatic group selected from the group consisting of a substituted or unsubstituted phenyl group, naphthyl group, and polyphenyl group and $R^3$ is selected from the group consisting of a substituted or unsubstituted aryl group, alkyl group having from 1 to 18 carbon atoms and cycloaliphatic compounds having from 3 to 18 carbon atoms. The substituents should be free form electron withdrawing groups such as $NO_2$ groups, CN groups, and the like. Typical aromatic amine compounds that are represented by this structural formula include:

I. Triphenyl amines such as:

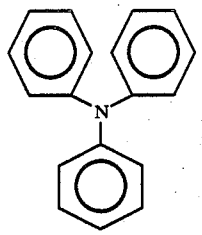

II. Bis and poly triarylamines such as:

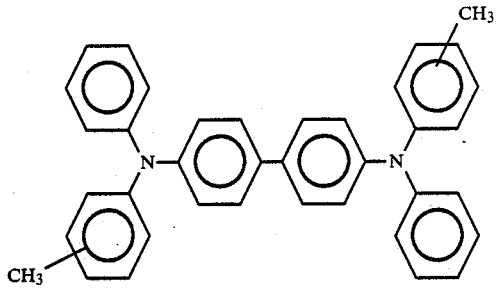

III. Bis arylamine ethers such as:

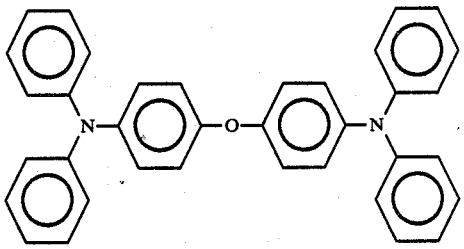

and

IV. Bis alkyl-arylamines such as:

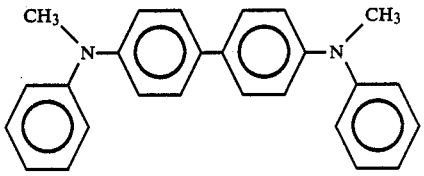

A preferred aromatic amine compound has the general formula:

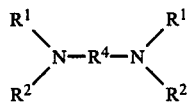

wherein $R^1$, and $R^2$ are defined above and $R^4$ is selected from the group consisting of a substituted or unsubstituted biphenyl group, diphenyl ether group, alkyl group having from 1 to 18 carbon atoms, and cycloaliphatic group having from 3 to 12 carbon atoms. The substituents should be free form electron withdrawing groups such as $NO_2$ groups, CN groups, and the like.

Excellent results in controlling dark decay and background voltage effects have been achieved when the imaging members doped in accordance with this invention comprising a charge generation layer comprise a layer of photoconductive material and a contiguous charge transport layer of a polycarbonate resin material having a molecular weight of from about 20,000 to about 120,000 having dispersed therein from about 25 to about 75 percent by weight of one or more compounds having the general formula:

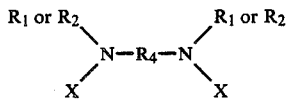

wherein $R_1$, $R_2$, and $R_4$ are defined above and X is selected from the group consisting of an alkyl group having from 1 to about 4 carbon atoms and chlorine, the photoconductive layer exhibiting the capability of photogeneration of holes and injection of the holes and the charge transport layer being substantially non-absorbing in the spectral region at which the photoconductive layer generates and injects photogenerated holes but being capable of supporting the injection of photogenerated holes from the photoconductive layer and transporting said holes through the charge transport layer.

Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl) phenylmethane; 4',4''-bis(diethylamino)-2',2''-dimethyltriphenyl-methane,N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3''-methylphenyl)-(1,1'-biphenyl)-4,4'-diamine, and the like dispersed in an inactive resin binder.

Any suitable inactive resin binder soluble in methylene chloride or other suitable solvent may be employed in the process of this invention. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000.

Any suitable stable protonic acid or Lewis acid or mixture thereof soluble in methylene chloride or other suitable solvent may be employed as a dopant in the transport layer of this invention to control dark decay and background potential. Stable protonic acids and Lewis acids do not decompose or form a gas at the temperatures and conditions employed in the preparation and use of the final multilayer photoconductor. Thus, protonic acids and Lewis acids having a boiling point greater than about 40° C. are especially prefered for greater stability during storage, transportation and operating conditions. Protonic acids generally are acids in which a proton ($H^+$) is available. Organic protonic acids include, for example, those having the following structural formulae:

$R_5$-COOH wherein $R_5$ is H or a substituted or unsubstituted alkyl group containing from 1 to 12 carbon atoms;

$R_6$-$SO_3H$ wherein $R_6$ is substituted or unsubstituted alkyl or aryl group containing from 1 to 18 carbon atoms;

$R_7$-COOH wherein $R_7$ is a substituted or unsubstituted cycloaliphatic or cycloaliphatic-aromatic group containing from 4 to 12 carbon atoms;

$R_8$-$SO_2H$ wherein $R_8$ is a substituted or unsubstituted alkyl, aryl, cycloalkyl group containing from 1 to about 12 carbon atoms; and

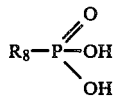 wherein $R_8$ is defined above.

Typical organic protonic acids represented by these formulas having a boiling point greater than about 40° C. and that are soluble in methylene chloride or other suitable solvent include trifluoroacetic acid, trichloroacetic acid, methane sulfonic acid, acetic acid, nitrobenzoic acid, benzene-sulfonic acid, benzene-phosphonic acid, trifluoro methane sulfonic acid, and the like and mixtures thereof. Optimum results are achieved with trifluoroacetic acid and trichloroacetic acid because of good solubility, acid strength and in case of $CF_3COOH$ good chemical stability. Inorganic protonic acids include halogen, sulfur, selenium tellurium or phophorous containing inorganic acids. Typical inorganic protonic acids include $H_2SO_4$, $H_3PO_4$, $H_2SeO_3$, $H_2SeO_4$. Other less preferred inorganic protonic acids having boiling point less than 40° C. include HCl, HBr, HI, and the like and mixtures thereof.

Lewis acids generally are electron acceptor acids which can combine with another molecule or ion by forming a covalent chemical bond with two electrons from the second molecule or ion. Typical Lewis acids include aluminum trichloride, Ferric trichloride, stannic tetrachloride, boron trifluoride, $ZnCl_2$, $TiCl_4$, $SbCl_5$, $CuCl_2$, $SbF_5$, $VCl_4$, $TaCl_5$, $ZrCl_4$, and the like and mixtures thereof. The protonic acids and Lewis acids should preferably have a boiling point greater than about 40° C. to avoid loss of the acid dopant during preparation, storage, transportation or use at higher temperatures. Acids of lower boiling points than 40° C. may be used where practical.

Methylene chloride solvent is a desirable component of the charge transport layer coating mixture for adequate dissolving of all the components and for its low boiling point. Surprisingly, it has been discovered that acid impurities in methylene chloride solvent dramatically affect the dark decay and dark discharge characteristics of the final multilayer photoconductor. Since the the relative amounts of acid impurities vary from one batch of methylene chloride solvent to another, the dark decay and dark discharge characteristics of the final multilayer photoconductor vary from one production run to another. Moreover, the effect of extremely slight changes in acid content on dark decay and dark discharge characteristics of the final multilayer photoconductor are most pronounced in the range of about 0 to about 10 and greater than 100 parts per million based on the weight of the methylene chloride solvent. Since batch to batch fluctuations in the relative quantities of acid impurities in commercially available methylene chloride is extremely minute, it is virtually impossible to rapidly and accurately quantify the amount of acid impurities with conventional analytical techniques. Thus, even if one were somehow above to recognize that freezing the relative amount of acid impurities in methylene chloride would aid in predicting the dark decay and dark discharge characteristics of the final multilayer photoconductor, the normal batch to batch fluctuations in the relative quantities of acid impurities in commercially available methylene chloride and the inadequate techniques for determining the relative quantities of acid impurities renders such freezing impractical. Even if one were to discover the adverse effects of the acid impurities in methylene chloride and purified the solvent prior to use, acid impurities can form in the solvent after purification by mere exposure to air, moisture and/or light.

Figure 2:
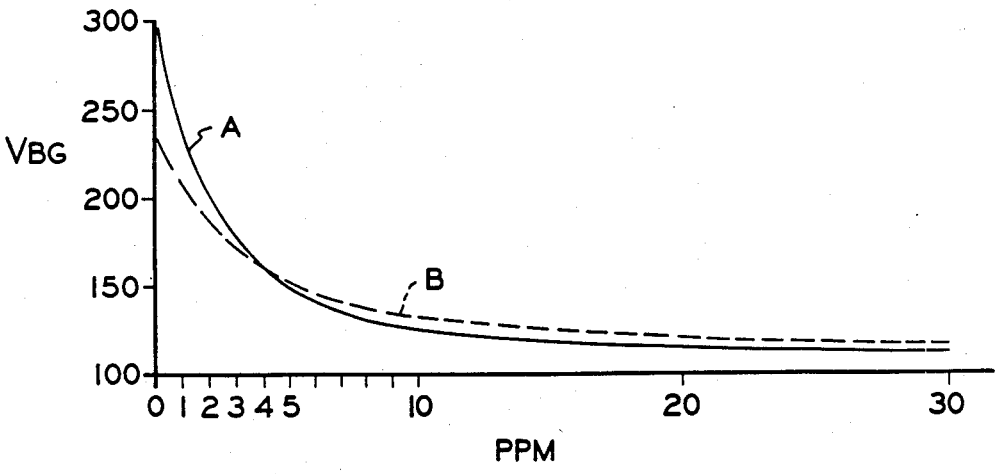
FIG. 2 graphically illustrates background potential ($V_{BG}$) characteristics with treated and untreated photosensitive members having two electrically operative layers on a conductive layer.

It has also been unexpectedly discovered that by adding to methylene chloride, to the aromatic amine, to the resin binder or to any combination of the transport layer components a controlled, predetermined amount of a protonic acid or Lewis acid having a boiling point greater than about 40° C. and soluble in methylene chloride, dark decay and dark discharge characteristics of the final multilayer photoconductor can be controlled and rendered predictable even when the methylene chloride contains batch to batch differences in the amount of acid impurities prior to the addition of the predetermined amount of protonic acid or Lewis acid. Remarkably, by merely adding a sufficient predetermined amount of protonic acid or Lewis acid to the methylene chloride, to the aromatic amine, to the resin binder or to any combination of the transport layer components, the dark decay and dark discharge characteristics of the final multilayer photoconductor can be made to inrease rapidly, level off and remain fairly constant up to about 100 ppm as illustrated in FIG. 1 and FIG. 2 and described in detail in the Examples which follow. Rapid increase in dark decay occurs thereafter with a resultant $V_{DDP}$ loss. Thus, the dark decay and dark discharge characteristics of the final multilayer photoconductor can be accurately pedicted and controlled even when the exact quantity of minor amounts of acid in the starting methylene chloride batch is unkown. Satisfactory results may be achieved when from about 0.1 part per million to about 1000 parts per million protonic acid or Lewis acid, based on the weight of the methylene chloride, is used to prepare the charge transport coating mixture. The optimum acid concentration depends on the strength of the acid used. When using the amount of charge transporting amine as a basis for determining the amount acid concentration to employ, the optimum acid concentration is between 1 ppm to 10,000 ppm based on the weight of charge transporting amine used. When less than about 0.1 part per million protonic acid or Lewis acid based on the weight of the methylene chloride or less than 1 ppm protonic acid or Lewis acid based on the weight of charge transporting amine is employed, the final multilayer photoconductor possesses higher $V_{DDP}$ and $V_{BG}$. The 0.1 ppm based on the weight of the methylene chloride or 1 ppm protonic acid or Lewis acid based on the weight of charge transporting amine is the minimum acid quantity that has any significant effect. Since the amount of acid impurities in commercially available methylene chloride is normally less than about 5 parts per million based on the weight of the methylene chloride, it dramatically affects the reproducibility of the dark decay and dark discharge characteristics and background of the final multilayer photoconductor. The deliberate addition of a proper level of a predetermined amount of protonic acid or Lewis acid to the methylene chloride, to the aromatic amine, to the resin binder or to any combination of the transport layer components causes the dark decay and dark discharge characteristics of the final multilayer photoconductor to level off and remain fairly constant at a predictable value, assuming that the initial amount of acid impurity is in the 0–5 ppm range, correcting the erratic batch to batch fluctuations in the amount of acid impurities present in the methylene chloride employed to prepare the charge transport layer coating mixture. An amount of protonic acid or Lewis acid exceeding about 1000 parts per million, based on the weight of the methylene chloride, results in very high dark decay and low $V_{DDP}$. An amount of protonic acid or Lewis acid between about 1 part per million to about 50 parts per million protonic acid or Lewis acid, based on the weight of the methylene chloride, is preferred because the desired photoreceptor properties remain fairly constant over this range of acid. The optimum amount of protonic acid or Lewis acid to be used within the ranges described above also depends to some extent upon the particular conductive electrode layer employed in the final multilayer photoconductor. Thus, the optimum amount of acid dopant for a multilayer photoconductor having a titanium conductive electrode layer is slightly different than the optimum amount of acid dopant for a multilayer photoconductor having an aluminum conductive electrode.

Generally, because the protonic acid or Lewis acid added to the charge transport layer coating mixture is employed in parts per million quantities, it is preferred to mix the acid dopant with a relatively large amount of methylene chloride to form a master batch and thereafter combine an appropriate amount of acid doped methylene chloride from the master batch with the other charge transport layer coating mixture components. The master batch can be prepared, for example, by initially preparing a 0.5 percent by weight solution of acid dopant in methylene chloride and thereafter diluting the solution with additional methylene chloride.

If desired, the methylene chloride solvent may be subjected to acid removal or neutralization treatments prior to acid doping. Also, if desired, the methylene chloride can be dried prior to acid doping. Furthermore, any formaldehyde which may be present and objectionable can be removed by a treatment with a suitable material such as sodium bisulfite. Any suitable technique may be utilized for such treatments. Typical acid removal or neutralization treatments include treatment with $K_2CO_3$, $CaCO_3$, $MgCO_3$, molecular sieve, ion exchange resins, and the like. Treatment by $K_2CO_3$, $NaHSO_3$ and molecular sieve is preferred because it removes acid, formaldehyde and water, respectively.

When methylene chloride solvent is subjected to acid removal or a neutralization treament without subsequent acid doping, the dark decay and dark discharge characteristics of the final multilayer photoconductor are unacceptably low, i.e. high $V_{DDP}$ and $V_{BG}$, for precision, high volume, high speed copiers, duplicators and printers.

Any suitable and conventional technique may be utilized to mix and thereafter apply the charge transport layer mixture to the charge generating layer. Typical application techniques include spraying, dip coating, roll coating, wire wound rod coating, and the like. Although it is preferred that the acid doped methylene chloride be prepared prior to application to the charge generating layer, one may instead add the acid to the aromatic amine, to the resin binder or to any combination of the transport layer components prior to coating. Drying of the deposited coating may be effected by any suitable conventional technique such as oven drying, infra red radiation drying, air drying and the like. Generally, the thickness of the transport layer is between about 5 to about 100 microns, but thicknesses outside this range can also be used.

The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to 200:1 and in some instances as great as 400:1. A typical transport layer forming composition is about 8.5 percent by weight charge transporting aromatic amine, about 8.5 percent by weight polymeric binder, and about 83 percent by weight methylene chloride. The methylene chloride can contain from about 0.1 ppm to about 1,000 ppm protonic or Lewis acid based on the of weight methylene chloride.

In some cases, intermediate layers between the blocking layer or conductive layer and the adjacent generator transport layer may be desired to improve adhesion or to act as an electrical barrier layer. If such layers are utilized, the layers preferably have a dry thickness between about 0.01 micron to about 0.1 microns. Typical adhesive layers include film-forming polymers such as polyester, polyvinylbutyral, polyvinylpyrolidone, polyurethane, polymethyl methacrylate and the like.

Optionally, an overcoat layer may also be utilized to improve resistance to abrasion. These overcoating layers may comprise organic polymers or inorganic polymers that are electrically insulating or slightly semi-conductive.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

Methylene chloride was treated with molecular sieves for the removal of water by placing 60 ml of methylene chloride and 15 grams of molecular sieves, 4 Angstroms, 10–16 mesh into a glass amber bottle. This mixture was allowed to remain in contact for 72 hours. The methylene chloride was thereafter decanted off of the molecular sieves.

EXAMPLE II

Methylene chloride was treated with potassium carbonate for the removal of Lewis acids or protonic acids by placing 60 ml of methylene chloride and 5 gm of anhydrous potassium carbonate into an Erlenmeyer flask. This mixture was stirred for 1 hour after which the potassium carbonate was separated from the methylene chloride by filtration.

EXAMPLE III

Methylene chloride containing various amounts of trichloroacetic acid was prepared by placing 500 gm of methylene chloride, "PHOTREX" Reagent Grade from J. T. Baker Chemical Co. into an amber glass bottle and then dissolving 0.56 gm Reagent Grade trichloroacetic acid crystal in the methylene chloride to obtain a solution containing 1120 ppm acid, based on the weight of methylene chloride. Appropriate dilutions of this solution were made using methylene chloride to obtain 500 ppm, 400 ppm, 300 ppm, 200 ppm, 100 ppm, 60 ppm, 40 ppm and 20 ppm trichloriacetic acid, based on the weight of methylene chloride.

EXAMPLE IV

Methylene chloride containing various amounts of trifluoroacetic acid was prepared by placing 500 gm of methylene chloride PHOTREX Reagent Grade from J. T. Baker Chemical Co. into an amber glass bottle and then dissolving 0.514 gm of Reagent Grade trifluoroacetic acid in the methylene chloride to obtain a solution containing 1028 ppm of acid, based on the weight of methylene chloride. Appropriate dilutions of this solution were made using methylene chloride to obtain 500 ppm, 400 ppm, 300 ppm, 200 ppm, 100 ppm, 60 ppm, 40 ppm and 20 ppm trifluoroacetic acid, based on the weight of methylene chloride.

EXAMPLE V

Methylene chloride containing 4 ppm and 30 ppm of trifluoroacetic acid was prepared by dissolving 0.5 percent by weight based on the weight of the total solution of Reagent Grade trifluoroacetic acid in technical grade methylene chloride available from Vulcan Chemical Co. (Vendor A). Subsequently, 0.36 gram of the 0.5 percent (wt.) solution was added to 454 grams of additional methylene chloride to obtain 4 ppm of acid based on the weight of methylene chloride. Additionally 2.7 grams of the 0.5 percent (wt.) solution was added tp 454 grams of the methylene chloride to obtain 30 ppm of acid based on the weight of methylene chloride.

EXAMPLE VI

Methylene chloride containing 4 ppm and 30 ppm of trifluoroacetic acid was prepared by dissolving 0.5 percent by weight based on the weight of the total solution of Reagent Grade trifluoroacetic acid in reagent grade methylene chloride available from Baker Chemical Co. (Vendor B). Subsequently, 0.36 gram of the 0.5 percent (wt.) solution was added to 454 grams of additional methylene chloride to obtain 4 ppm of acid based on the weight of methylene chloride. Additionally 2.7 grams of the 0.5 percent (wt.) solution was added tp 454 grams of the methylene chloride to obtain 30 ppm of acid based on the weight of methylene chloride.

EXAMPLE VII

A photoreceptive device was prepared by providing an aluminized mylar substrate having a thickness of 3 mils and applying thereto, using a Bird applicator, a solution containing 2.592 gm 3-aminopropyltriethoxysilane, 0.784 gm acetic acid, 180 gm of 190 proof denatured alcohol and 77.3 gm heptane. This layer was then allowed to dry for 5 minutes at room temperature and 10 minutes at 135° C. in a forced air oven. The resulting blocking layer had a dry thickness of 0.01 micrometer.

An adhesive interface layer was then prepared by the applying to the blocking layer a coating having a wet thickness of 0.5 mil and containing 0.5 percent by weight based on the total weight of the solution DuPont 49,000 adhesive in a 70:30 volume ratio mixture of tetrahydrofuran/cyclohexanone with a Bird applicator. The adhesive interface layer was allowed to dry for 1 minute at room temperature and 10 minutes at 100° C. in a forced air oven. The resulting adhesive interface layer had a dry thickness of 0.05 micrometer.

The adhesive surface layer was thereafter coated with a photogenerating layer containing 7.5 percent by volume trigonal Se, 25 percent by volume N,N'-diphenyl-N,N'-bis(3-methylphenyl)-1,1'-biphenyl-4,4'-diamine, and 67.5 percent by volume polyvinylcarbazole. This photogenerating layer was prepared by introducing 0.8 gram polyvinyl carbazole and 14 ml of a 1:1 volume ratio of a mixture of tetrahydrofuran and toluene into a 2 oz. amber bottle. To this solution was added 0.8 gram of trigonal selenium and 100 grams of ⅛ inch diameter stainless steel shot. This mixture was then placed on a ball mill for 72 to 96 hours. Subsequently, 5 grams of the resulting slurry were added to a solution of 0.36 gm of polyvinyl carbazole and 0.20 gm of N,N'-diphenyl-N,N'-bis(3-methylphenyl)-1,1'-biphenyl-4,4'-diamine in 7.5 ml of 1:1 volume ratio of tetrahydrofuran/toluene. This slurry was then placed on a shaker for 10 minutes. The resulting slurry was thereafter applied to the adhesive interface with a Bird applicator to form a layer having a wet thickness of 0.5 mil. The layer was dried at 135° C. for 5 minutes in a forced air oven to form a dry thickness photogenerating layer having a thickness of 2.0 microns.

This photogenerator layer was overcoated with a charge transport layer. The charge transport layer was prepared by introducing into an amber glass bottle in a weight ratio of 1:1 N,N'-diphenyl-N,N'-bis(3-methylphenyl)-1,1'-biphenyl-4,4'-diamine and Makrolon®, a polycarbonate resin having a molecular weight of from about 50,000 to 100,000 commercially available from Larbensabricken Bayer A. G. The resulting mixture was dissolved in 15 percent by weight untreated methylene chloride used in Examples III and IV. This solution was applied on the photogenerator layer using a Bird applicator to form a coating which upon drying had a thickness of 25 microns. During this coating process the humidity was equal to or less than 15 percent. The resulting photoreceptor device containing all of the above layers was annealed at 135° C. in a forced air oven for 6 minutes. Except for the type of treated or untreated methylene chloride solvent employed, the procedures described in this Example were used to prepare the photoreceptors described in the Examples VIII through IX below.

EXAMPLE VIII

Photoreceptors having two electrically operative layers as described in Example VII were prepared using the same procedures and materials except that an acid treated methylene chloride solvent prepared as described in Example III was used instead of the untreated methylene chloride.

EXAMPLE IX

Photoreceptors having two electrically operative layers as described in Example VII were prepared using the same procedures and materials except that an acid treated methylene chloride solvent prepared as described in Example IV was used instead of the untreated methylene chloride.

EXAMPLE X

A photoreceptive device was prepared by providing an titanium metalized mylar substrate having a thickness of 3 mils and applying thereto, using a Bird applicator, a solution containing 2.592 gm 3-aminopropyltriethoxysilane, 0.784 gm acetic acid, 180 gm of 190 proof denatured alcohol and 77.3 gm heptane. This layer was then allowed to dry for 5 minutes at room temperature and 10 minutes at 135° C. in a forced air oven. The resulting blocking layer had a dry thickness of 0.01 micrometer.

An adhesive interface layer was then prepared by the applying to the blocking layer a coating having a wet thickness of 0.5 mil and containing 0.5 percent by weight based on the total weight of the solution DuPont 49,000 adhesive in a 70:30 volume ratio mixture of tetrahydrofuran/cyclohexanone with a Bird applicator. The adhesive interface layer was allowed to dry for 1 minute at room temperature and 10 minutes at 100° C. in a forced air oven. The resulting adhesive interface layer had a dry thickness of 0.05 micrometer.

The adhesive interface layer was thereafter coated with a photogenerating layer containing 7.5 percent by volume trigonal Se, 25 percent by volume N,N'-diphenyl-N,N'-bis(3-methylphenyl)-1,1'-biphenyl-4,4'-diamine, and 67.5 percent by volume polyvinylcarbazole. This photogenerating layer was prepared by introducing 0.8 gram polyvinyl carbazole and 14 ml of a 1:1 volume ratio of a mixture of tetrahydrofuran and toluene into a 2 oz. amber bottle. To this solution was added 0.8 gram of trigonal selenium and 100 grams of ⅛ inch diameter stainless steel shot. This mixture was then placed on a ball mill for 72 to 96 hours. Subsequently, 5 grams of the resulting slurry were added to a solution of 0.36 gm of polyvinyl carbazole and 0.20 gm of N,N'-diphenyl-N,N'-bis(3-methylphenyl)-1,1'-biphenyl-4,4'-diamine in 7.5 ml of 1:1 volume ratio of tetrahydrofuran/toluene. This slurry was then placed on a shaker for 10 minutes. The resulting slurry was thereafter applied to the adhesive interface with a Bird applicator to form a layer having a wet thickness of 0.5 mil. The layer was dried at 135° C. for 5 minutes in a forced air oven to form a dry thickness photogenerating layer having a thickness of 2.0 microns.

This photogenerator layer was overcoated with a charge transport layer. The charge transport layer was prepared by introducing into an amber glass bottle in a weight ratio of 1:1 N,N'-diphenyl-N,N'-bis(3-methylphenyl)-1,1'-biphenyl-4,4'-diamine and Makrolon®, a polycarbonate resin having a molecular weight of from about 50,000 to 100,000 commercially available from Larbensabricken Bayer A. G. The resulting mixture was dissolved in 15 percent by weight untreated methylene chloride from Vulcan Chemical Co. (Vendor A). This solution was applied on the photogenerator layer using a Bird applicator to form a coating which upon drying had a thickness of 25 microns. During this coating process the humidity was equal to or less than 15 percent. The resulting photoreceptor device containing all of the above layers was annealed at 135° C. in a forced air oven for 6 minutes. Except for the type of treated or untreated methylene chloride solvent employed, the procedures described in this Example were used to prepare the photoreceptors described in the Examples XI and XII below.

EXAMPLE XI

Photoreceptors having two electrically operative layers as described in Example X were prepared using the same procedures and materials except that 4 ppm acid treated methylene chloride solvent prepared as described in Example V was used instead of the untreated methylene chloride.

EXAMPLE XII

Photoreceptors having two electrically operative layers as described in Example X were prepared using the same procedures and materials except that 30 ppm acid treated methylene chloride solvent prepared as described in Example V was used instead of the untreated methylene chloride.

EXAMPLE XIII

A photoreceptive device was prepared by providing an titanium metalized mylar substrate having a thickness of 3 mils and applying thereto, using a Bird applicator, a solution containing 2.592 gm 3-aminopropyltriethoxysilane, 0.784 gm acetic acid, 180 gm of 190 proof denatured alcohol and 77.3 gm heptane. This layer was then allowed to dry for 5 minutes at room temperature and 10 minutes at 135° C. in a forced air oven. The resulting blocking layer had a dry thickness of 0.01 micrometer.

An adhesive interface layer was then prepared by the applying to the blocking layer a coating having a wet thickness of 0.5 mil and containing 0.5 percent by weight based on the total weight of the solution DuPont 49,000 adhesive in a 70:30 volume ratio mixture of tetrahydrofuran/cyclohexanone with a Bird applicator. The adhesive interface layer was allowed to dry for 1 minute at room temperature and 10 minutes at 100° C. in a forced air oven. The resulting adhesive interface layer had a dry thickness of 0.05 micrometer.

The adhesive interface layer was thereafter coated with a photogenerating layer containing 7.5 percent by volume trigonal Se, 25 percent by volume N,N'-diphenyl-N,N'-bis(3-methylphenyl)-1,1'-biphenyl-4,4'-diamine, and 67.5 percent by volume polyvinylcarbazole. This photogenerating layer was prepared by introducing 0.8 gram polyvinyl carbazole and 14 ml of a 1:1 volume ratio of a mixture of tetrahydrofuran and toluene into a 2 oz. amber bottle. To this solution was added 0.8 gram of trigonal selenium and 100 grams of ⅛ inch diameter stainless steel shot. This mixture was then placed on a ball mill for 72 to 96 hours. Subsequently, 5 grams of the resulting slurry were added to a solution of 0.36 gm of polyvinyl carbazole and 0.20 gm of N,N'-diphenyl-N,N'-bis(3-methylphenyl)-1,1'-biphenyl-4,4'-diamine in 7.5 ml of 1:1 volume ratio of tetrahydrofuran/toluene. This slurry was then placed on a shaker for 10 minutes. The resulting slurry was thereafter applied to the adhesive interface with a Bird applicator to form a layer having a wet thickness of 0.5 mil. The layer was dried at 135° C. for 5 minutes in a forced air oven to form a dry thickness photogenerating layer having a thickness of 2.0 microns.

This photogenerator layer was overcoated with a charge transport layer. The charge transport layer was prepared by introducing into an amber glass bottle in a weight ratio of 1:1 N,N'-diphenyl-N,N'-bis(3-methylphenyl)-1,1'-biphenyl-4,4'-diamine and Makrolon®, a polycarbonate resin having a molecular weight of from about 50,000 to 100,000 commercially available from Larbensabricken Bayer A. G. The resulting mixture was dissolved in 15 percent by weight untreated methylene chloride from J. T. Baker Chemical Co. (Vendor B). This solution was applied on the photogenerator layer using a Bird applicator to form a coating which upon drying had a thickness of 25 microns. During this coating process the humidity was equal to or less than 15 percent. The resulting photoreceptor device containing all of the above layers was annealed at 135° C. in a forced air oven for 6 minutes. Except for the type of treated or untreated methylene chloride solvent employed, the procedures described in this Example were used to prepare the photoreceptors described in the Examples XIV and XV below.

EXAMPLE XIV

Photoreceptors having two electrically operative layers as described in Example XIII were prepared using the same procedures and materials except that 4 ppm acid treated methylene chloride solvent prepared as described in Example VI was used instead of the untreated methylene chloride.

EXAMPLE XV

Photoreceptors having two electrically operative layers as described in Example XIII were prepared using the same procedures and materials except that 30 ppm acid treated methylene chloride solvent prepared as described in Example VI was used instead of the untreated methylene chloride.

EXAMPLE XVI

A photoreceptor prepared with untreated methylene chloride solvent and photoreceptors prepared with the different acid treated methylene chloride solvents all methylene chloride solvent material originally from Vulcan Chemical Co. (Vendor A) and the corresponding $V_{DDP}$ and $V_{BG}$ are compared in the Table below:

| Trifluoroacetic acid (ppm) | $V_{DDP}$ | $V_{BG}$ |
|---|---|---|
| 0 (Example X) | 827 | 298 |
| 4 (Example XI) | 723 | 160 |
| 30 (Example XII) | 668 | 112 |

Curves plotted from these values of $V_{DDP}$ are illustrated in FIG. 1. Curves plotted from these values of $V_{BG}$ are illustrated in FIG. 2. These curves clearly demonstrate how both $V_{DDP}$ and $V_{BG}$ vary in photoreceptors prepared from untreated methylene chloride solvent from different vendors and how untreated methylene chloride solvent can adversely affect the $V_{DDP}$ and $V_{BG}$ photoreceptors prepared from untreated methylene chloride solvents.

EXAMPLE XVII

A photoreceptor prepared with untreated methylene chloride solvent and photoreceptors prepared with the acid treated methylene chloride solvents, all methylene chloride solvent material originally from (Vendor B) and the corresponding $V_{DDP}$ and $V_{BG}$ are compared in the Table below:

| Trifluoroacetic acid (ppm) | $V_{DDP}$ | $V_{BG}$ |
|---|---|---|
| 0 (Example XIII) | 794 | 235 |
| 4 (Example XIV) | 739 | 160 |
| 30 (Example XV) | 695 | 117 |

The samples were charged with a DC corotron to a surface charge density of $1.2\times10^{-7}$ coulombs/cm$^2$. The dark development potential, $V_{DDP}$ was measured 0.6 second after charge using an electrostatic voltmeter with the samples kept in the dark. The background potential, $V_{BG}$, was determined by charging the sample to the same current density as above in the dark, exposing 0.16 second later with 3.8 ergs/cm$^2$ of white light restricted to the 400 nm to 700 nm spectral range, and measuring the surface potential at 0.6 second after charge.

Curves plotted from these values of $V_{DDP}$ are illustrated in FIG. 1. Curves plotted from these values of $V_{BG}$ are illustrated in FIG. 2. These curves clearly demonstrate how both $V_{DDP}$ and $V_{BG}$ vary in photoreceptors prepared from untreated methylene chloride solvent from different vendors and how untreated methylene chloride solvent can adversely affect the $V_{DDP}$ and $V_{BG}$ photoreceptors prepared from untreated methylene chloride solvents. These curves also show how the acid treatment of methylene chloride solvents in accordance to this invention can reduce $V_{DDP}$ and $V_{BG}$ and bring $V_{DDP}$ and $V_{BG}$ values into a reproducible and predictable region.

EXAMPLE XVIII

A photoreceptor prepared in Examples VII and VIII prepared from untreated methylene chloride solvent and photoreceptors prepared with the methylene chloride solvents treated with trichloroacetic acid as described in Example III, all methylene chloride solvent material originally from the same vendor, and the corresponding $V_{DDP}$ and $V_{BG}$ values are compared in the Table below:

| Trichloroacetic acid (ppm) | $V_{DDP}$ | $V_{BG}$ |
|---|---|---|
| 0 | 705 | 84 |
| 20 | 559 | 91 |
| 40 | 492 | 78 |
| 60 | 480 | 66 |
| 100 | 389 | 52 |
| 200 | 75 | — |
| 300 | 36 | — |
| 400 | 30 | — |
| 500 | 30 | — |

Figure 3:
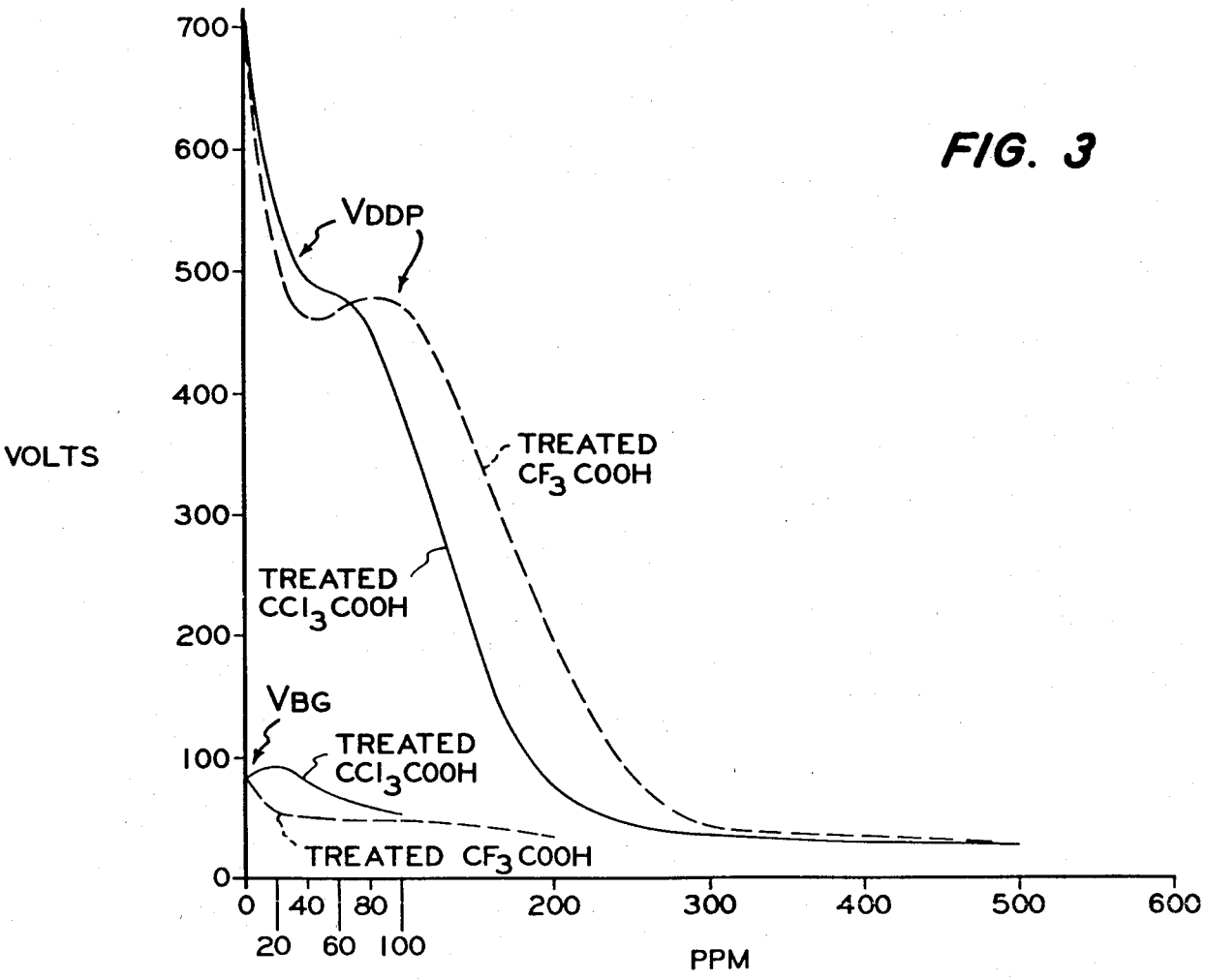
FIG. 3 graphically illustrates background potential ($V_{BG}$) and ($V_{DDP}$) characteristics of photosensitive members having two electrically operative layers on a conductive layer treated with various amounts of two different organic acids.

A curve plotted from these values of $V_{DDP}$ and $V_{BG}$ is illustrated in FIG. 3. This curve clearly demonstrates how both $V_{DDP}$ and $V_{BG}$ of photoreceptors prepared from untreated methylene chloride solvents can be adversely affected. This curve also shows how trichloroacetic acid treatment of methylene chloride solvents in accordance with this invention can reduce $V_{DDP}$ and $V_{BG}$ and bring $V_{DDP}$ and $V_{BG}$ values into a reproducible and predictable region.

EXAMPLE XIX

A photoreceptor prepared in Example VII and IX prepared with untreated methylene chloride solvent and photoreceptors prepared with the methylene chloride solvents treated with trifluoroacetic acid as described in Example IV and the corresponding $V_{DDP}$ and $V_{BG}$ values are compared in the Table below:

| Trifluoroacetic acid (ppm) | $V_{DDP}$ | $V_{BG}$ |
|---|---|---|
| 0 | 705 | 84 |
| 20 | 519 | 53 |
| 40 | 461 | 52 |
| 60 | 467 | 49 |
| 100 | 473 | 49 |
| 200 | 196 | 35 |
| 300 | 40 | — |
| 400 | 35 | — |
| 500 | 26 | — |

A curve plotted from these values of $V_{DDP}$ and $V_{BG}$ is illustrated in FIG. 3. This curve clearly demonstrates how both $V_{DDP}$ and $V_{BG}$ of photoreceptors prepared from untreated methylene chloride solvents can be adversely affected. This curve also shows how trifluoroacetic acid treatment of methylene chloride solvents in accordance with this invention can reduce $V_{DDP}$ and $V_{BG}$ and bring $V_{DDP}$ and $V_{BG}$ values into a reproducible and predictable region.

Although the invention has been described with reference to specific preferred embodiments, it is not intended to be limited thereto, rather those skilled in the art will recognize that variations and modifications may be made therein which are within the spirit of the invention and within the scope of the claims.

We claim:

1. A process for preparing an electrophotographic imaging member comprising providing a photogenerating layer on a supporting substrate, applying a coating of a charge transport layer forming mixture to said photogenerating layer, said charge transport layer forming mixture comprising a charge transporting aromatic amine compound of one or more compounds having the general formula:

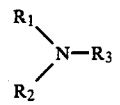

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl, and alkyl group having from 1 to 18 carbon atoms and a cycloaliphatic group having from 3 to 12 carbon atoms, said groups being free of electron withdrawing groups, a polymeric film forming resin in which said aromatic amine is soluble, solvent for said polymeric film forming resin, and from about 1 part per million to about 10,000 parts per million, based on the weight of said aromatic amine, of a protonic acid or Lewis acid soluble in said solvent and drying said coating, said photogenerating layer exhibiting the capability of photogeneration of holes and injection of said holes, said charge transport layer being substantially non-absorbing in the spectral region at which said photogenerating layer generates and injects photogenerated holes by being capable of supporting the injection of photogenerated holes from said photogenerating layer and transporting said holes through said charge transport layer, said charge transport layer being an insulator to the extent that an electrostatic charge placed on said charge transport layer is retained in the absence of illumination for the formation and retention of an electrostatic latent image thereon, and said charge transport layer having a thickness greater than the thickness of said photogenerating layer.

2. A process for preparing an electrophotographic imaging member comprising providing a photogenerating layer on a supporting substrate, applying a coating of a charge transport layer forming mixture to said photogenerating layer, said charge transport layer forming mixture comprising a charge transporting aromatic amine compound of one or more compounds having the general formula:

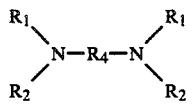

wherein $R_1$ and $R_2$ are an aromatic group selected from the group consisting of a substituted or unsubstituted phenyl group, naphthyl group, and polyphenyl group and $R_4$ is selected from the group consisting of a substituted or unsubstituted biphenyl group, diphenyl ether group, alkyl group having from 1 to 18 carbon atoms, and cycloaliphatic group having from 3 to 12 carbon atoms, a polycarbonate film forming resin in which said aromatic amine is soluble, methylene chloride solvent for said polymeric film forming resin, and from about 1 part per million to about 10,000 parts per million, based on the weight of said aromatic amine, of a protonic acid or Lewis acid having a boiling point greater than about 40° C. and soluble in said methylene chloride solvent and drying said coating, said photogenerating layer exhibiting the capability of photogeneration of holes and injection of said holes, said charge transport layer being substantially non-absorbing in the spectral region at which said photogenerating layer generates and injects photogenerated holes by being capable of supporting the injection of photogenerated holes from said photogenerating layer and transporting said holes through said charge transport layer, said charge transport layer being an insulator to the extent that an electrostatic charge placed on said charge transport layer is retained in the absence of illumination for the formation and retention of an electrostatic latent image thereon, and the ratio of the thickness of said charge transport layer to the thickness of said photogenerating layer being maintained between about 2:1 and about 200:1.

3. A process for preparing an electrophotographic imaging member in accordance with claim 2, including purifying said methylene chloride prior to incorporation into said charge transport layer forming mixture.

4. A process for preparing an electrophotographic imaging member in accordance with claim 3, including purifying said methylene chloride prior to incorporation into said charge transport layer forming mixture by treating said methylene chloride with reagents to deacidify and remove formaldehyde and water from said methylene chloride.

5. A process for preparing an electrophotographic imaging member in accordance with claim 3, including purifying said methylene chloride prior to incorporation into said charge transport layer forming mixture by treating said methylene chloride with a reagent selected from the group consisting of $K_2CO_3$, $MgCO_3$, $NaHSO_3$, and molecular sieve.

6. A process for preparing an electrophotographic imaging member in accordance with claim 2, including forming a solution of said protonic acid or Lewis acid in said methylene chloride prior to incorporation of said solution into said charge transport layer forming mixture.

7. A process for preparing an electrophotographic imaging member in accordance with claim 1, wherein said supporting substrate comprises a titanium layer.

8. A process for preparing an electrophotographic member in accordance with claim 1, wherein said aromatic amine compound has the general formula:

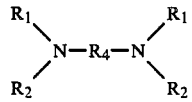

wherein $R_1$ and $R_2$ are an aromatic group selected from the group consisting of a substituted or unsubstituted phenyl group, naphthyl group, and polyphenyl group and $R_4$ is selected from the group consisting of a substituted or unsubstituted biphenyl group, aryl group, diphenyl ether group, alkyl group having from 1 to 18 carbon atoms and cycloaliphatic group having from 3 to 12 carbon atoms, the ratio of the thickness of said charge transport layer to said photogenerating layer being maintained from between about 2:1 and about 200:1.

9. A process for preparing an electrophotographic imaging member in accordance with claim 2, wherein said charge transport layer forming mixture comprises from about 10 parts per million to about 500 parts per million, based on the weight of said aromatic amine, of said protonic acid or Lewis acid and wherein said supporting substrate comprises a metal oxide layer of a conductive anode and wherein a blocking layer is interposed between said metal oxide layer and said photogenerating layer, said blocking layer comprising a reaction product between a hydrolyzed amino silane and said metal oxide layer.

10. A process for preparing an electrophotographic imaging member in accordance with claim 2, wherein said protonic acid is selected from the group consisting of trifluoroacetic acid, trichloroacetic acid, acetic acid and mixtures thereof.

* * * * *